US009761967B2

(12) United States Patent
Urano

(10) Patent No.: US 9,761,967 B2
(45) Date of Patent: Sep. 12, 2017

(54) CONNECTOR AND ILLUMINATING DEVICE

(71) Applicant: Japan Aviation Electronics Industry, Limited, Tokyo (JP)

(72) Inventor: Tetsu Urano, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 181 days.

(21) Appl. No.: 14/769,335

(22) PCT Filed: Mar. 6, 2014

(86) PCT No.: PCT/JP2014/055745
§ 371 (c)(1),
(2) Date: Aug. 20, 2015

(87) PCT Pub. No.: WO2014/174912
PCT Pub. Date: Oct. 30, 2014

(65) Prior Publication Data

US 2016/0134033 A1 May 12, 2016

(30) Foreign Application Priority Data

Apr. 23, 2013 (JP) ..... 2013-090147

(51) Int. Cl.
*H01R 11/22* (2006.01)
*H01R 12/53* (2011.01)
(Continued)

(52) U.S. Cl.
CPC ..... *H01R 12/53* (2013.01); *F21K 9/20* (2016.08); *H01R 4/48* (2013.01); *H01R 13/11* (2013.01);
(Continued)

(58) Field of Classification Search
CPC .... H01R 13/11; H01R 13/113; H01R 13/187; H01R 13/6608; H01R 43/16; H01R 9/091; H01R 23/727; G02F 1/133604
(Continued)

(56) References Cited

U.S. PATENT DOCUMENTS 5,664,972 A 9/1997 Zinn et al.
5,775,962 A 7/1998 Kakuta et al.
(Continued)

FOREIGN PATENT DOCUMENTS

CN 1466246 A 1/2004
CN 1758485 A 4/2006
(Continued)

OTHER PUBLICATIONS

Chinese Office Action in CN 201480017038.8, dated Sep. 30, 2016, with English translation.
(Continued)

*Primary Examiner* — Hien Vu
(74) *Attorney, Agent, or Firm* — Collard & Roe, P.C.

(57) ABSTRACT

A connector has an insertion opening for a cable at a front end of thereof in a front-rear direction. The connector has a bottom portion, a first section and a second section. The bottom portion has opposite ends in a lateral direction perpendicular to the front-rear direction. The first section and the second section extend from the opposite ends, respectively, of the bottom portion. The first section and the second section overlap with each other so that the first section, the second section and the bottom portion form the insertion opening. The first section is formed with a first engagement portion. The second section is formed with a second engagement portion. The first engagement portion and the second engagement portion face each other in a perpendicular direction perpendicular to the front-rear direc-
(Continued)

tion. Even if at least one of the first section and the second section receives a force forcing the first section and the second section to be away from each other in the lateral direction, the first engagement portion and the second engagement portion are brought into abutment with each other in the perpendicular direction.

9 Claims, 7 Drawing Sheets

(51) Int. Cl.

| | |
|---|---|
| ***H01R 4/48*** | (2006.01) |
| ***H01R 13/11*** | (2006.01) |
| ***F21K 9/20*** | (2016.01) |
| *F21V 23/00* | (2015.01) |
| *F21V 23/06* | (2006.01) |
| *F21V 3/00* | (2015.01) |
| *H01R 12/57* | (2011.01) |
| *H01R 43/16* | (2006.01) |
| *F21Y 115/10* | (2016.01) |

(52) U.S. Cl.
CPC ..... *F21V 3/00* (2013.01); *F21V 23/001* (2013.01); *F21V 23/06* (2013.01); *F21Y 2115/10* (2016.08); *H01R 12/57* (2013.01); *H01R 43/16* (2013.01)

(58) Field of Classification Search
USPC ..... 439/851, 852, 853, 620.02
See application file for complete search history.

(56) References Cited

U.S. PATENT DOCUMENTS

| | | | | |
|---|---|---|---|---|
| 5,951,336 | A * | 9/1999 | Seko | H01R 13/432 439/745 |
| 6,679,738 | B2 * | 1/2004 | Nimura | H01R 43/16 439/752.5 |
| 6,729,904 | B2 | 5/2004 | Nankou et al. | |
| 6,872,103 | B1 | 3/2005 | Flieger et al. | |
| 6,955,571 | B2 * | 10/2005 | Fujii | H01H 85/2035 439/856 |
| 7,048,582 | B2 * | 5/2006 | Tabata | H01R 13/113 439/595 |
| 7,048,597 | B2 | 5/2006 | Chen | |
| 7,387,550 | B2 * | 6/2008 | Myer | H01R 13/113 439/852 |
| 7,513,793 | B2 | 4/2009 | Horst et al. | |
| 8,870,588 | B2 | 10/2014 | Kudo et al. | |
| 2002/0077000 | A1 | 6/2002 | Nimura | |

FOREIGN PATENT DOCUMENTS

| | | | |
|---|---|---|---|
| CN | 101645542 | A | 2/2010 |
| JP | H03-097869 | U | 10/1991 |
| JP | H07-037635 | A | 2/1995 |
| JP | H9-134751 | A | 5/1995 |
| JP | 2001-035558 | A | 2/2001 |
| JP | 2002-522883 | A | 7/2002 |
| JP | 2005-166300 | A | 6/2005 |
| JP | 2010-514138 | A | 4/2010 |
| JP | 2011-129506 | A | 6/2011 |
| JP | 2012-079462 | A | 4/2012 |
| TW | 201218561 | A | 5/2012 |

OTHER PUBLICATIONS

Japanese Office Action in JP 2013-090147, dated Jun. 29, 2016, with English translation.
International Search Report of PCT/JP2014/055745, dated Jun. 3, 2014.
Taiwanese Office Action in TW 103108321, dated Dec. 24, 2015, with English translation.

* cited by examiner

CONNECTOR AND ILLUMINATING DEVICE

CROSS REFERENCE TO RELATED APPLICATIONS

This application is the National Stage of PCT/JP2014/055745 filed on Mar. 6, 2014, which claims priority under 35 U.S.C. §119 of Japanese Application No. 2013-090147 filed on Apr. 23, 2013, the disclosures of which are incorporated by reference. The international application under PCT article 21(2) was not published in English.

TECHNICAL FIELD

This invention relates to a connector which connects between a connection object, such as a substrate, and a cable. In addition, this invention relates to a lighting device comprising the connector.

BACKGROUND ART

Patent document 1 discloses a lighting device comprising a connector of this type. As shown in FIG. 13A, the connector of Patent document 1 comprises a connection member made of conductor and a housing made of insulator. As shown in FIG. 13B, the connection member is provided with a contact portion, which is brought into contact with a conductor portion of a cable inserted into the connector, and a pressing spring portion which presses the conductor portion against the contact portion.

Patent Document 1 discloses, as a modification, a connector having no housing, namely, the connector consisting only of the connection member. In addition, a shape of the connection member of the modification is same as that of an embodiment of Patent document 1.

PRIOR ART DOCUMENTS

Patent Document(s)

Patent Document 1: JP A 2012-79462

SUMMARY OF INVENTION

Technical Problem

It is not necessary for the modification of Patent Document 1 to have the housing. Thus, according to the modification of Patent Document 1, the number of the components of the connector is small so that man-hour requirements for assembling it can be reduced and so that its material cost and its assembly cost can be reduced.

However, the modification of Patent Document 1 has a problem in strength because the connector is based on the embodiment having the housing.

It is therefore an object of the present invention to provide a connector which can have a constant strength even if the connector has no housing.

In addition, it is another object of the present invention to provide a lighting device which comprises the above-described connector.

Solution to Problem

An aspect of the present invention provides a connector having, at a front end thereof, an insertion opening which enables a conductor portion of a cable to be inserted thereinto along a front-rear direction, wherein:

the connector has a bottom portion, a first section and a second section;

the bottom portion has opposite ends in a lateral direction perpendicular to the front-rear direction;

the first section and the second section extend from the opposite ends, respectively, of the bottom portion;

the first section and the second section overlap with each other so that the first section, the second section and the bottom portion form the insertion opening;

the first section is formed with a first engagement portion;

the second section is formed with a second engagement portion;

the first engagement portion and the second engagement portion face each other in a perpendicular direction perpendicular to the front-rear direction; and even if at least one of the first section and the second section receives a force which forces the first section and the second section to be away from each other in the lateral direction, the first engagement portion and the second engagement portion are brought into abutment with each other in the perpendicular direction.

Another aspect of the present invention provides a lighting device comprising: an LED (light-emitting diode) element; a substrate on which the LED element is mounted; the connector which is connected to and fixed on the substrate; and a cable which is inserted into the connector while being connected to the LED element through the connector and the substrate.

Advantageous Effects of Invention

Even if, for example, the second section is pushed in a direction away from the first section in the lateral direction by moving and bending the inserted cable, the first engagement portion and the second engagement portion are brought into abutment with each other so that movement of the second section can be suppressed. Thus, according to the present invention, a strength of the connector is ensured.

An appreciation of the objectives of the present invention and a more complete understanding of its structure may be had by studying the following description of the preferred embodiment and by referring to the accompanying drawings.

DESCRIPTION OF EMBODIMENTS

Figure 1:
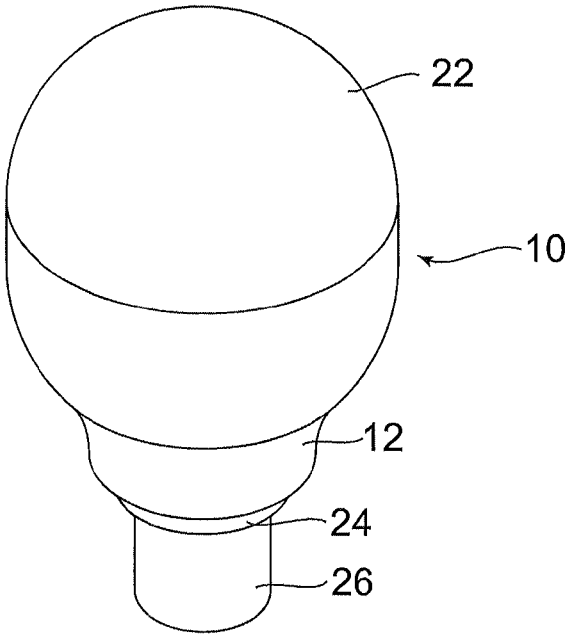
FIG. 1 is a perspective view showing a lighting device according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Figure 2:
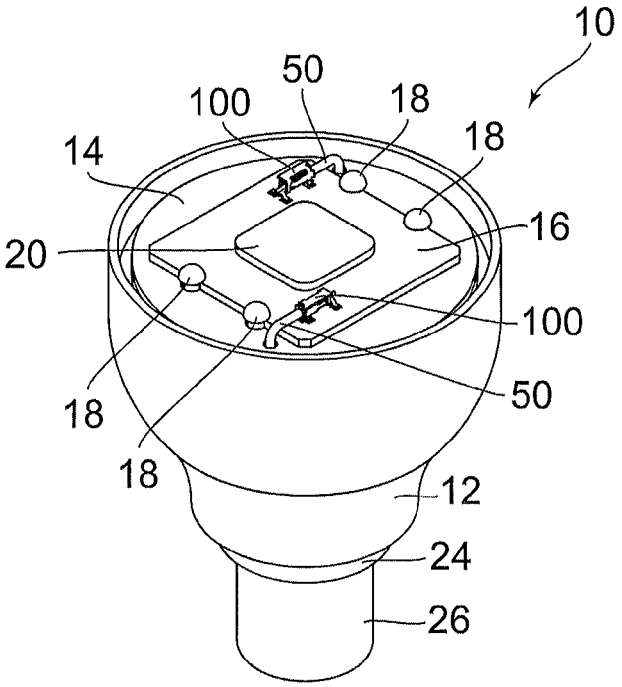
FIG. 2 is another perspective view showing the lighting device of FIG. 1. A cover is detached from the illustrated lighting device.

With reference to FIGS. 1 and 2, a lighting device 10 according to an embodiment of the present invention comprises a heat radiation member 12, a heat transmission member 14, a substrate 16, an LED (light-emitting diode) element 20, a cover 22, a component fixing member 24, a base portion 26, two cables 50 and two connectors 100.

The heat radiation member 12 is a die-cast product made of metal having high heat conductive characteristics, such as aluminum, and is formed to have a cylindrical shape. Although the illustrated heat radiation member 12 has a smooth outer periphery, many fins for heat radiation may be provided on the outer periphery.

As shown in FIG. 2, the heat transmission member 14 is made of metal having high heat conductive characteristics, such as aluminum, and is formed to have a substantially disk-like shape. The heat transmission member 14 is fixed in the vicinity of an upper end of the heat radiation member 12.

Figure 10:
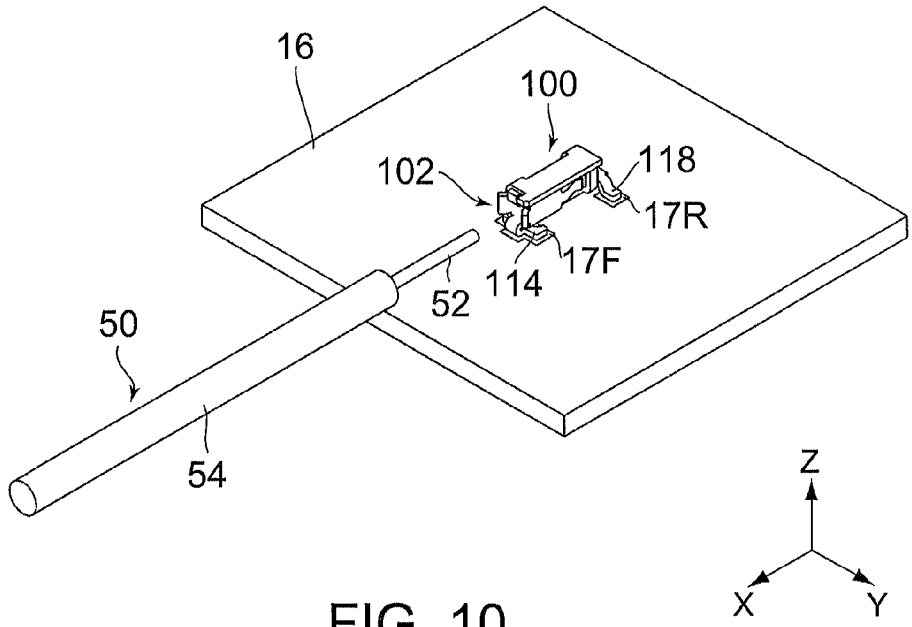
FIG. 10 is a perspective view showing a process where a cable is inserted into the connector of FIG. 3.
Figure 11:
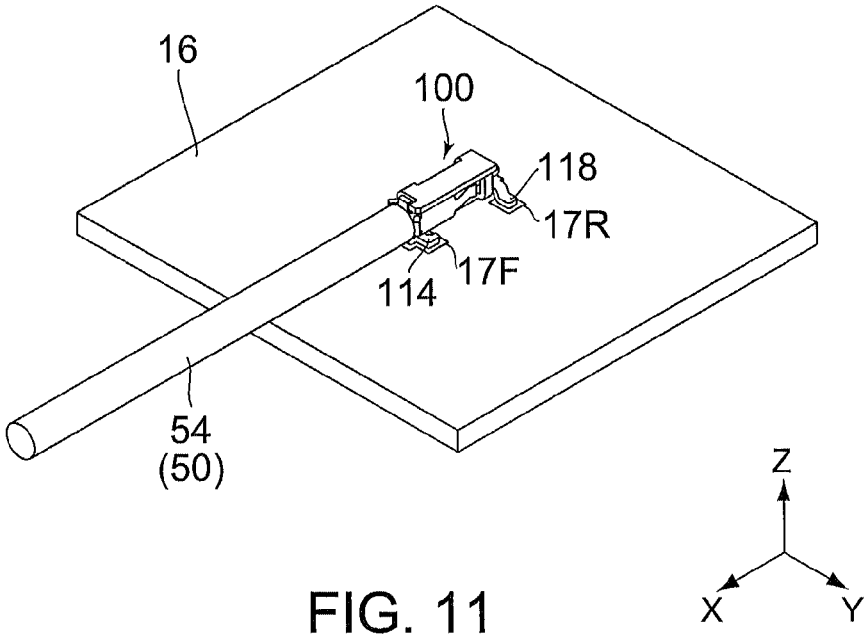
FIG. 11 is a perspective view showing a state where the cable is inserted into the connector of FIG. 3.
Figure 12:
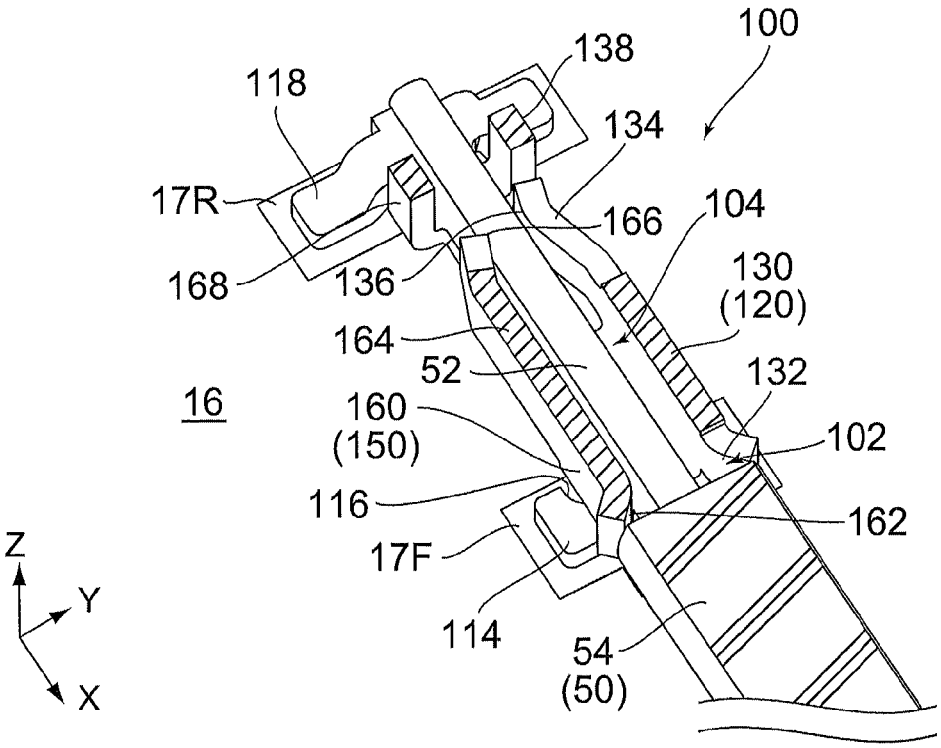
FIG. 12 is a cross-sectional, perspective view showing the state of FIG. 11.
Figure 13A:
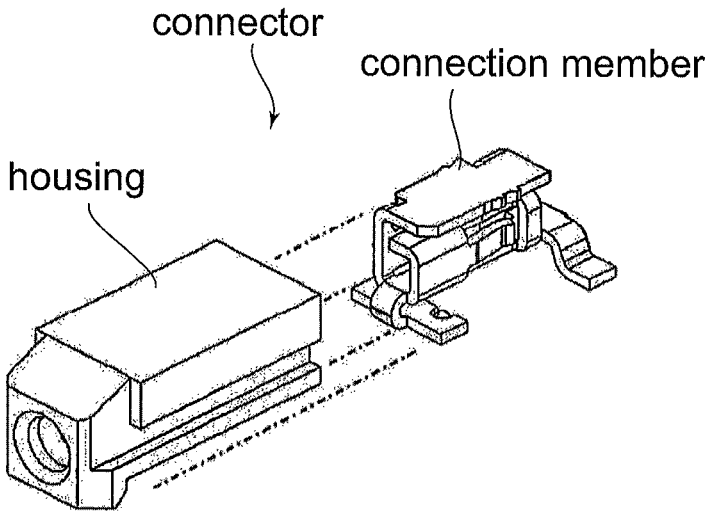
FIG. 13A PRIOR ART
FIG. 13A is an exploded, perspective view showing a connector of Patent Document 1.
Figure 13B:
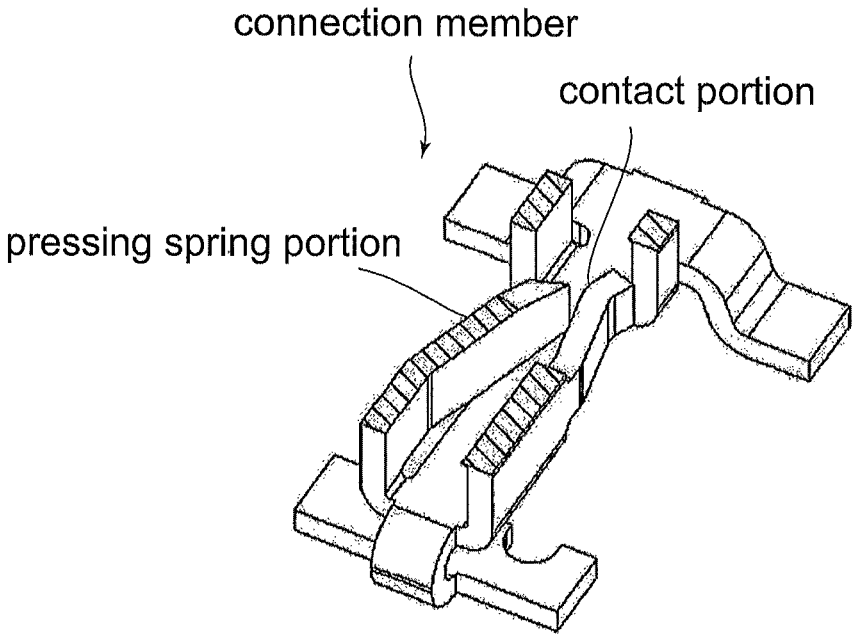
FIG. 13B PRIOR ART
FIG. 13B is a cross-sectional, perspective view showing a connection member which is included in the connector of Patent Document 1.

The substrate 16 has a substantially rectangular shape and is fixed on an upper surface of the heat transmission member 14 by a plurality of screws 18. The fixing enables heat to be received and transferred between the substrate 16 and the heat transmission member 14. As shown in FIGS. 10 to 12, an upper surface of the substrate 16 is formed with a plurality of conductive patterns 17F, 17R. As described in detail later, the conductive patterns 17F, 17R are connected with the connector 100.

With reference to FIG. 2 again, the LED element 20 is provided on a center portion of the upper surface of the substrate 16. The LED element 20 may be formed by connecting a plurality of small elements, or may be formed of a single element. Two electrodes of the LED element 20 are connected with the two connectors 100, respectively, through the conductive patterns 17F, 17R (see FIGS. 10 to 12) of the substrate 16. The illustrated connectors 100 have structures same as each other. Detailed explanation will be made later about the structure of the connector 100 as referring to Figures.

As shown in FIG. 1, the cover 22 has a dome-like shape and is provided so as to cover the substrate 16 and the LED element 20 from above. The cover 22 is made from, for example, glass, transparent resin or translucent resin.

As shown in FIGS. 1 and 2, the component fixing member 24 is positioned below the heat radiation member 12. In detail, an upper portion of the component fixing member 24 is mated with and fixed to an inside of a lower portion of the heat radiation member 12. A lower portion of the component fixing member 24 is exposed outside the heat radiation member 12. The base portion 26 is attached to the exposed lower portion of the component fixing portion 24. The base portion 26 and the connectors 100 are connected with each other through the cables 50 and components (not shown) which are provided inside the heat radiation member 12. Accordingly, electric power can be supplied to the LED element 20 through the base portion 26, the cables 50, the connectors 100 and the conductive patterns 17F, 17R of the substrate 16. In addition, as shown in FIGS. 10 and 12, each of the cables 50 comprises a conductor portion 52 and an outer cover 54 which covers the conductor portion 52 and which is made of insulator. Explanation will be made later about specific connection of the cable 50 and the connector 100.

As shown in FIGS. 3 to 9, the connector 100 has an insertion opening 102 at a front end (positive X-side end), and a receive portion 104 is formed rearward thereof (in a negative X-direction). The connector 100 according to the present embodiment is formed by punching out a single metal plate to obtain an intermediate member, followed by bending the intermediate member. As understood from FIGS. 10 to 12, the conductor portion 52 of the cable 50 is inserted into the connector 100 from the insertion opening 102 along a front-rear direction (X-direction) so that the connector 100 is electrically connected with the conductor portion 52 of the cable 50 in the receive portion 104.

In detail, the connector 100 has a bottom portion 110, a first section 120 and a second section 150 as shown in FIGS. 3 to 9.

The bottom portion 110 has an elongated, plate-like shape which extends long in the front-rear direction (X-direction) while extending short in a lateral direction (Y-direction). A front end (positive X-side end) of the bottom portion 110 is provided with a lower guide portion 112 having a surface oblique to the front-rear direction (X-direction) which is an insertion direction of the conductor portion 52, and, furthermore, a front connection portion 114 extends rearward (in the negative X-direction) from the lower guide portion 112. The front connection portion 114 is positioned below (toward a negative Z-side of) the bottom portion 110. As understood from the above explanation, the front connection portion 114 is formed by folding a front part of the bottom portion 110 rearward, and the folded part functions as the lower guide portion 112.

The front connection portion 114 extends outward of the bottom portion 110 in the lateral direction. The front connection portion 114 is formed with recesses 116 each of which is recessed forward (in a positive X-direction). Each of the recesses 116 serves to receive an excessive solder when the front connection portion 114 is soldered to the conductive pattern 17F (see FIG. 12).

A rear end (negative X-side end) of the bottom portion 110 is provided with rear connection portions 118. Each of the rear connection portions 118 extends outward of the bottom portion 110 in the lateral direction (Y-direction). The rear connection portions 118 are soldered to the conductive pattern 17R (see FIG. 12).

Figure 7:
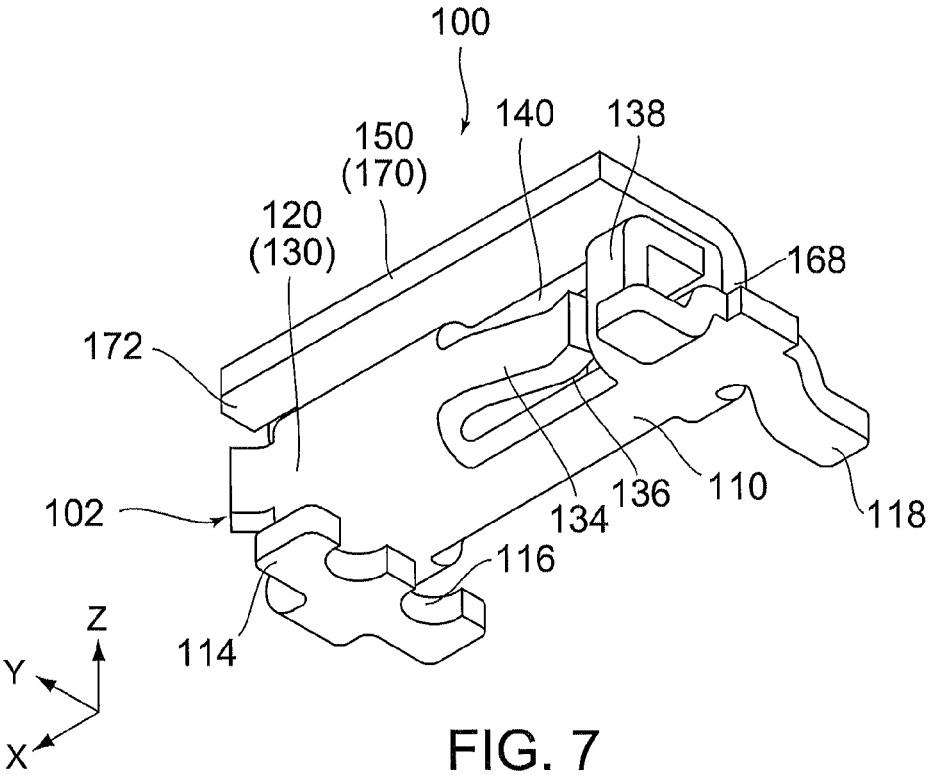
FIG. 7 is a rear, lower perspective view showing the connector of FIG. 3.
Figure 8:
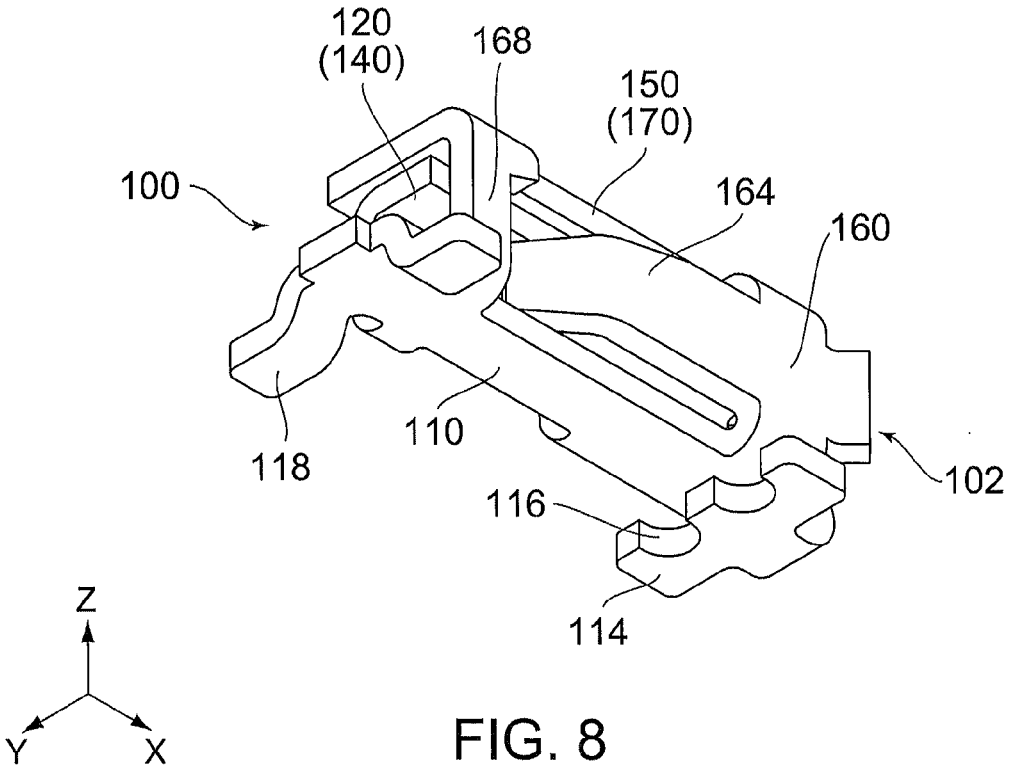
FIG. 8 is a rear, lower perspective view showing the connector of FIG. 3.

As understood from FIGS. 7 and 8, the first section 120 (first side portion 130 and first top portion 140) and the second section 150 (second side portion 160 and second top portion 170) extend from opposite ends of the bottom portion 110 in the lateral direction (Y-direction), respectively. Both of the first section 120 and the second section 150 extend upward (in a positive Z-direction) and are then bent so as to extend inward in the lateral direction (Y-direction), and overlap with each other at a position where a top portion (positive Z-side portion) of the connector 100 is formed. The overlap enables the bottom portion 110, the first section 120 and the second section 150 to form a substantially rectangular tube-like shape and to form the insertion opening 102 and the receive portion 104.

As shown in FIGS. 3, 4, 6 and 7, the first section 120 has a first side portion 130 and a first top portion 140. The first side portion 130 extends upward (in the positive Z-direction) from a right side end (one end in the lateral direction: positive Y-side end) of the bottom portion 110. The illustrated first side portion 130 has a plate-like shape which is mainly perpendicular to the lateral direction. The first top portion 140 extends inward in the lateral direction from an upper end (positive Z-side end) of the first side portion 130. The first top portion 140 has a plate-like shape which is mainly perpendicular to an up-down direction (Z-direction).

Figure 9:
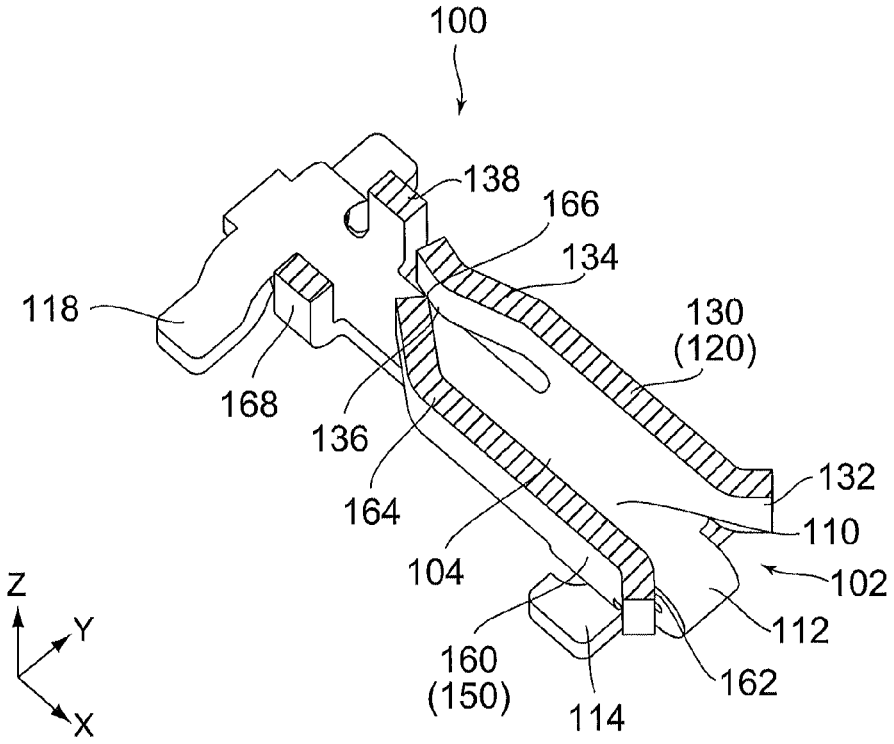
FIG. 9 is a cross-sectional, perspective view showing the connector of FIG. 4.

A front end (positive X-side end) of the first side portion 130 is provided with a first guide portion 132 which extends outward (rightward) in the lateral direction (Y-direction). The first guide portion 132 has a surface oblique to the front-rear direction (X-direction: insertion direction of the conductor portion 52). A rear end (negative X-side end) of the first side portion 130 is provided with a supporting spring portion 134 which extends rearward (in the negative X-direction) while being resiliently deformable. As shown in FIG. 9, the supporting spring portion 134 has a dog-leg-like shape or a shape similar to another shape of the Japanese Hiragana character of "he". A bent portion, which has the dog-leg-like shape or the shape similar to the shape of Japanese Hiragana character of "he", protrudes toward an inside of the receive portion 104, and functions as a contact portion 136 which is brought into contact with the conductor portion 52 inserted into the receive portion 104.

Moreover, a first positional regulating portion (positional regulating portion) 138 is provided rearward (toward a negative X-side) of the supporting spring portion 134. Specifically, in the front-rear direction, the supporting spring portion 134 is positioned between the first positional regulating portion 138 and the first side portion 130. Similar to the first side portion 130, the first positional regulating portion 138 extends upward from the right side end of the bottom portion 110. The first positional regulating portion 138 is a portion which regulates a position of an end of the conductor portion 52 inserted into the receive portion 104. In the present embodiment, an upper end (positive Z-side end) of the first positional regulating portion 138 is coupled with the first top portion 140.

As understood from FIGS. 3, 4, 7 and 8, the first top portion 140 has an elongated, plate-like shape which extends long in the front-rear direction (X-direction) while extending short in the lateral direction (Y-direction). As previously described, the first top portion 140 according to the present embodiment is coupled with the bottom portion 110 by the first side portion 130 and the first positional regulating portion 138. A front end (positive X-side end) of the first top portion 140 is provided with an upper guide portion 142 which extends upward (in the positive Z-direction). The upper guide portion 142 has a surface oblique to the front-rear direction (X-direction: insertion direction of the conductor portion 52). One of two side edges, which is near to the first guide portion 132, of the upper guide portion 142, i.e. a right side edge or a positive Y-side edge, functions as a first engagement portion 144. The first engagement portion 144 is described later in detail.

Figure 4:
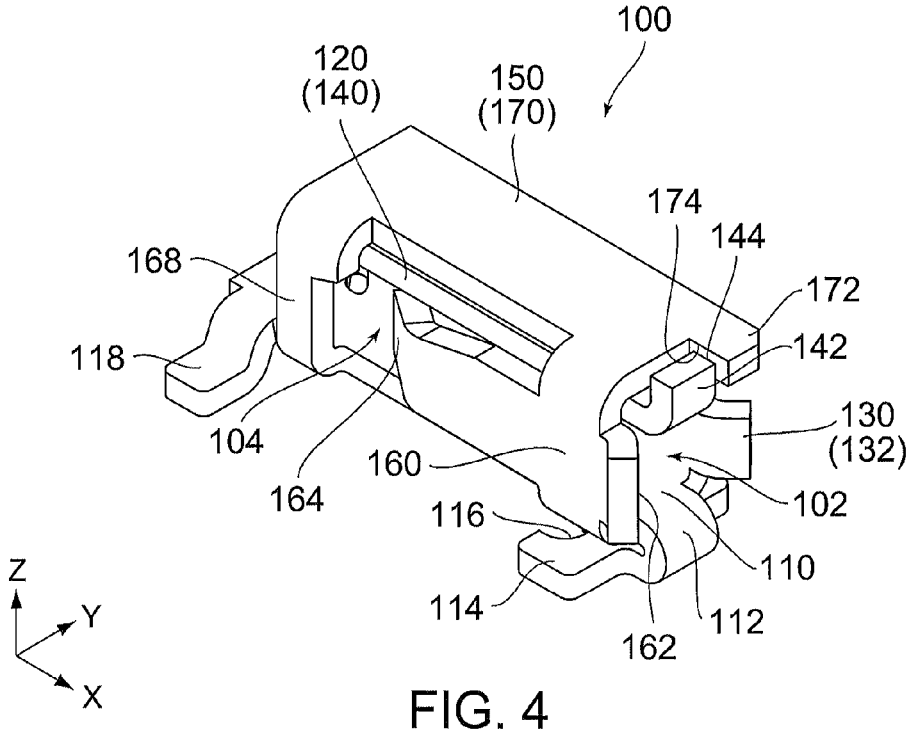
FIG. 4 is, another front, upper perspective view showing the connector of FIG. 3.

As shown in FIGS. 4 and 8, the second section 150 has a second side portion 160 and a second top portion 170. The second side portion 160 extends upward (in the positive Z-direction) from a left side end (the other end in the lateral direction: negative Y-side end) of the bottom portion 110. The illustrated second side portion 160 has a plate-like shape which is mainly perpendicular to the lateral direction. The second top portion 170 extends inward in the lateral direction from an upper end (positive Z-side end) of the second side portion 160. The second top portion 170 has a plate-like shape which is mainly perpendicular to the up-down direction (Z-direction).

Figure 3:
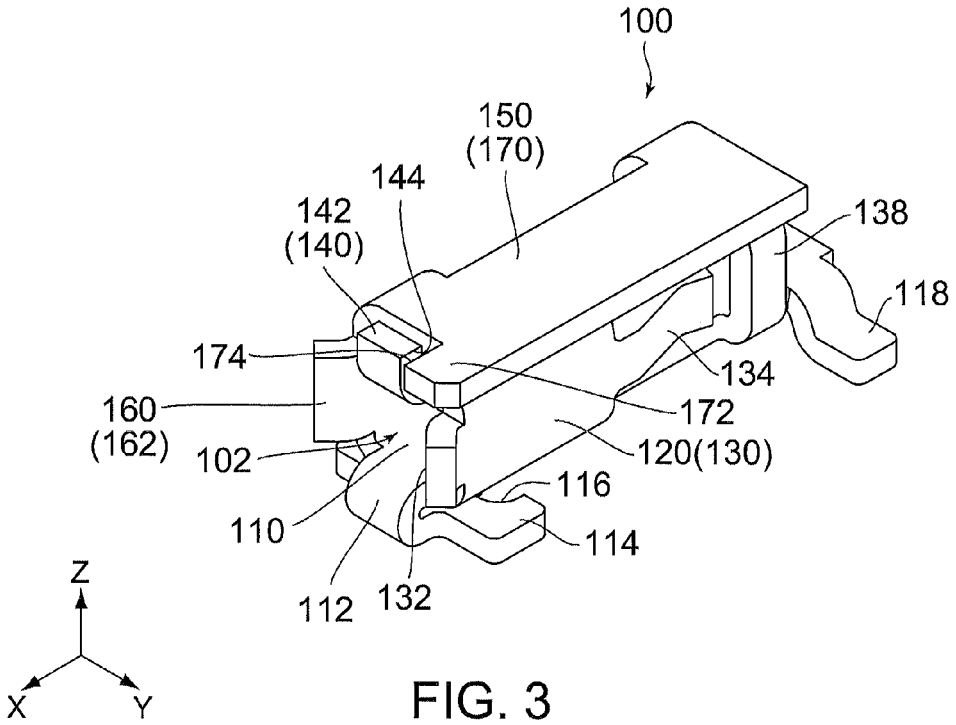
FIG. 3 is a front, upper perspective view showing a connector which is included in the lighting device of FIG. 2.

As shown in FIGS. 3 and 4, a front end (positive X-side end) of the second side portion 160 is provided with a second guide portion 162 which extends outward (leftward) in the lateral direction (Y-direction). The second guide portion 162 has a surface oblique to the front-rear direction (X-direction: insertion direction of the conductor portion 52). A rear end (negative X-side end) of the second side portion 160 is provided with a pressing spring portion 164 which extends rearward (in the negative X-direction) while being resiliently deformable. The pressing spring portion 164 is a portion which presses the conductor portion 52 of the inserted cable 50 against the contact portion 136.

Figure 5:
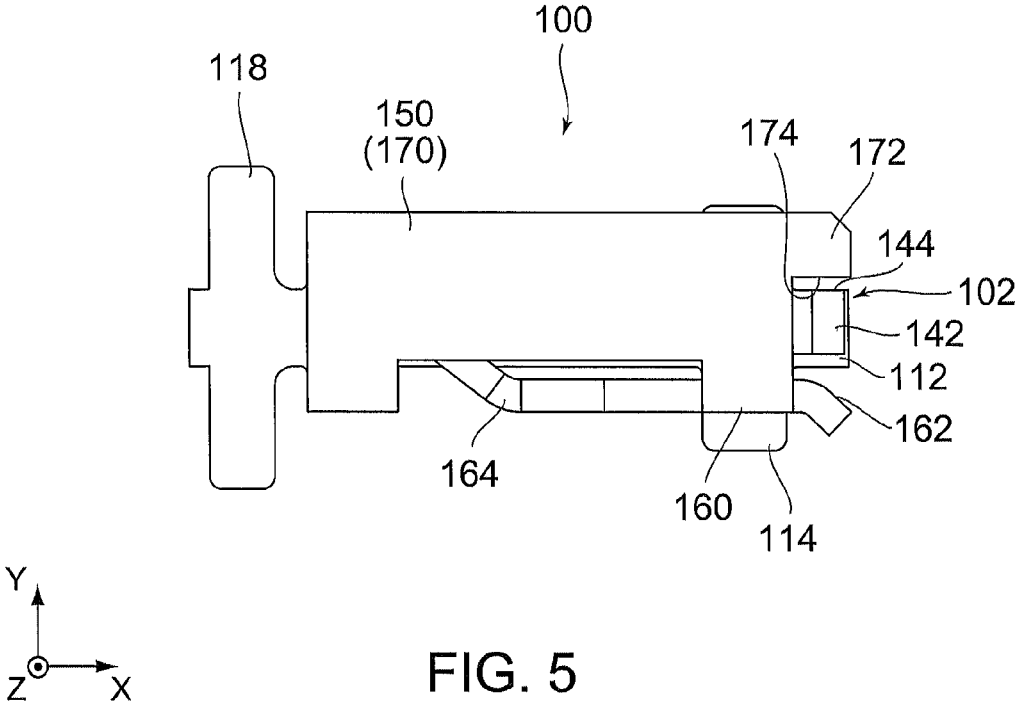
FIG. 5 is a top view showing the connector of FIG. 3.
Figure 6:
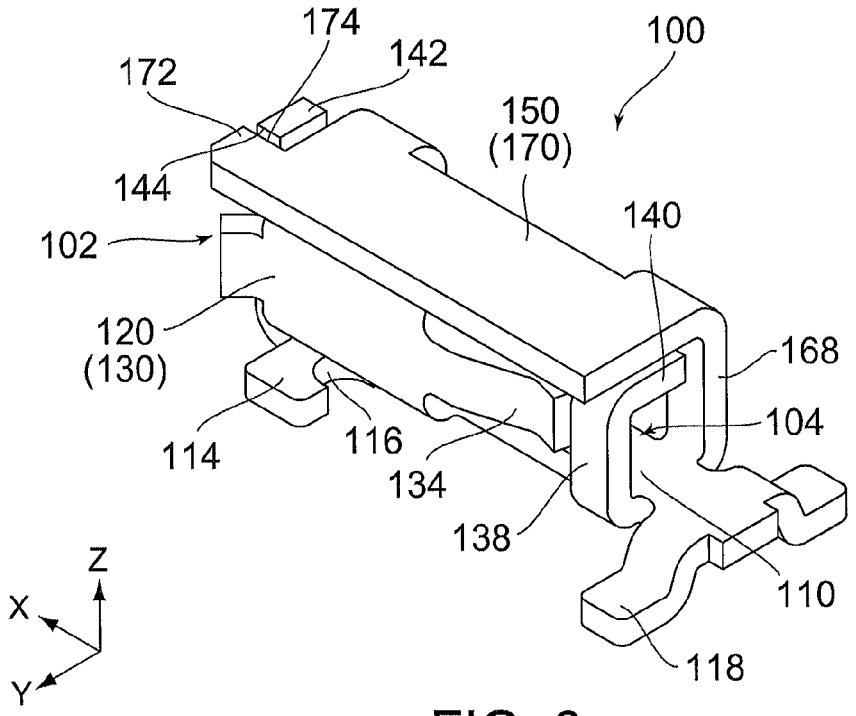
FIG. 6 is a rear, upper perspective view showing the connector of FIG. 3.

As understood from FIGS. 3 to 5, the lower guide portion 112, the first guide portion 132, the upper guide portion 142 and the second guide portion 162 are each positioned at a frontmost position in the front-rear direction and form the insertion opening 102 of the connector 100. The positions of the lower guide portion 112, the first guide portion 132, the upper guide portion 142 and the second guide portion 162 in the front-rear direction are same as each other. Thus, as understood from FIGS. 11 and 12, when the conductor portion 52 of the cable 50 is inserted into the receive portion 104, the outer cover 54 of the cable 50 is brought into abutment with the lower guide portion 112, the first guide portion 132, the upper guide portion 142 and the second guide portion 162. Accordingly, only the conductor portion 52 from which the outer cover 54 is peeled off is insertable into the receive portion 104. Since the lower guide portion 112, the first guide portion 132, the upper guide portion 142 and the second guide portion 162 are positioned at positions same as each other in the front-rear direction as described above, it is easy to control an insertion depth of the conductor portion 52.

In particular, since the front connection portion 114 of the present embodiment is folded back below the bottom portion 110 at the lower guide portion 112, when the conductor portion 52 of the cable 50 is inserted into the receive portion 104, the cable 50 can be prevented from receiving an unfavorable force by its outer cover 54 riding on the front connection portion 114, and the conductor portion 52 of the cable 50 can be pushed into the receive portion 104 until the outer cover 54 abuts the lower guide portion 112.

As shown in FIGS. 9 and 12, an end of the pressing spring portion 164 is provided with a corner portion (edge) 166 which is brought into pressing contact with the conductor portion 52 when the pressing spring portion 164 presses the conductor portion 52 against the contact portion 136. Although the corner portion 166 according to the present embodiment has a right angle in a horizontal plane (XY-plane), the corner portion 166 may be formed to have an acute angle. Since the corner portion 166 is brought into pressing contact with the conductor portion 52, even if the conductor portion 52 is to be pulled out in the positive X-direction, the conductor portion 52 is caught by the corner portion 166 so that the conductor portion 52 can be prevented from being easily pulled out from the connector 100.

Moreover, a second positional regulating portion (positional regulating portion) 168 is provided rearward (toward a negative X-side) of the pressing spring portion 164. Specifically, in the front-rear direction, the pressing spring portion 164 is positioned between the second positional regulating portion 168 and the second side portion 160. The second positional regulating portion 168 is a portion which regulates the position of the end of the conductor portion 52 inserted into the receive portion 104. In the present embodiment, an upper end (positive Z-side end) of the second positional regulating portion 168 is coupled with the second top portion 170.

While, as understood from FIG. 12, the end of the conductor portion 52 of the cable 50 might be swung to left or right when the cable 50 is moved and bent in the lateral direction, the conductor portion 52 can be prevented from protruding outside of the connector 100 because, according to the present embodiment, positional regulating portions which consist of the first positional regulating portion 138 and the second positional regulating portion 168 are provided at opposite sides of the end of the conductor portion 52, respectively.

As shown in FIGS. 3 to 5, the second top portion 170 has an elongated, relatively large plate-like shape which extends long in the front-rear direction (X-direction) while extending short in the lateral direction (Y-direction). As previously described, the second top portion 170 according to the present embodiment is coupled with the bottom portion 110 by the second side portion 160 and the second positional regulating portion 168.

The second top portion 170 according to the present embodiment is positioned above the first top portion 140. Specifically, the first section 120 and the second section 150 overlap with each other at their upper portions. The second top portion 170 according to the present embodiment is used as a suction surface which is picked up by vacuum suction in an automated placement process.

A front end (positive X-side end) of the second top portion 170 is formed with a protrusion portion 172 which protrudes forward (in the positive X-direction). The protrusion portion 172 is positioned at one, which is near to the first guide portion 132, of side spaces of the upper guide portion 142. In other words, the protrusion portion 172 is position rightward (toward a positive Y-side) of the upper guide portion 142. One of two side edges, which is near to the second guide portion 162, of the protrusion portion 172, i.e. a left side edge or a negative Y-side edge, functions as a second engagement portion 174, and faces the first engagement portion 144 in the lateral direction as best illustrated in FIG. 5. Accordingly, even if at least one of the first section 120 and the second section 150 receives a force which forces the first section 120 and the second section 150 to be away from each other in the lateral direction, the first engagement portion 144 and the second engagement portion 174 are brought into abutment with each other in the lateral direction so that a deformation of the connector 100 is suppressed. Thus, the connector 100 according to the present embodiment, even if comprising no housing, can have a high strength.

As shown in FIGS. 3, 4, 9 and 12, since the pressing spring portion 164 must press the conductor portion 52 of the cable 50 against the contact portion 136 to make a reliable contact therebetween, it is necessary for the pressing spring portion 164 to have high spring characteristics. On the other hand; it is not necessary for the aforementioned supporting spring portion 134 to have such characteristics as described above. Accordingly, in the present embodiment, a length of the pressing spring portion 164 is designed to be longer than another length of the supporting spring portion 134. In addition, the corner portion 166 and the contact portion 136 are positioned at almost the same position in the front-rear direction so that the corner portion 166 definitely presses the conductor portion 52 against the contact portion 136. Therefore, a length of a coupling portion which couples the bottom portion 110 with the second side portion 160 is shorter than another length of a coupling portion which couples the bottom portion 110 with the first side portion 130. Accordingly, in the present embodiment, especially the second side portion 160 is weaker in structure than the first side portion 130.

Since the first engagement portion 144 and the second engagement portion 174 are arranged so as to face each other in the lateral direction in the present embodiment, even if, for example, the cable 50 whose conductor portion 52 is inserted into the receive portion 104 is moved and bent to press the second side portion 160 leftward (in the negative Y-direction), the second engagement portion 174 is brought into abutment with the first engagement portion 144 to disperse a force to the first engagement portion 130 which is relatively strong in structure, so that the deformation of the connector 100 is suppressed.

While the connector and the lighting device according to the present invention has been described with specific embodiments, the present invention is not limited to the aforementioned embodiments but can be variously applied and modified.

For example, although the first engagement portion 144 and the second engagement portion 172 face each other in the lateral direction (Y-direction) in the present embodiment, the present invention is not limited thereto. The first engagement portion 144 and the second engagement portion 174 may face each other in a direction (perpendicular direction) perpendicular to the front-rear direction (X-direction: insertion direction of the conductor portion 52 of the cable 50). For example, the first engagement portion 144 and the second engagement portion 174 may face each other in the up-down direction (Z-direction). In other words, the up-down direction may be the perpendicular direction. Specifically, the first engagement portion and the second engagement portion may face each other in the up-down direction as follows; the second section 150 is formed to include an additional side portion which extends downward from a right side end of the second top portion 170 while the additional side portion is provided with a portion equivalent to the protrusion portion 172, and a size of the first guide portion 132 in the up-down direction (Z-direction) is reduced to half of its original size while the portion equivalent to the protrusion portion 172 is positioned below the first guide portion 132. In this case, the first section and the second section overlap with each other in the lateral direction (Y-direction).

Although, in the above-described embodiment, the first engagement portion 144 and the second engagement portion 174 are formed of a part of the upper guide portion 142 and a part of the protrusion portion 172, respectively, each of which forms the front end, the present invention is not limited thereto. For example, the second top portion 170 may be formed with an opening and then a part of the first top portion 140 may be bent to be inserted into the opening of the second top portion 170. In this case, an inner edge of the opening and a side edge of the first top portion 140 inserted into the opening serve as the second engagement portion and the first engagement portion, respectively. However, in terms of simplifying the structure of the connector 100 without reducing functions which the connector 100 has, it is preferable for the first engagement portion 144 and the second engagement portion 174 to be formed as the part of the upper guide portion 142 and the part of the protrusion portion 172, respectively, similar to the present embodiment.

Although the connector 100 has a substantially rectangular tube-like shape in the above-described embodiment, the present invention is not limited thereto. The connector 100 may have, for example, a substantially cylindrical shape or a substantially elliptical-cylindrical shape.

Although the corner portion 166 is provided at an end of the pressing spring portion 164 in the above-described embodiment, the present invention is not limited thereto. For example, the contact portion 136 may be formed to have a shape similar to the corner portion 166 while the pressing spring portion 164 may be formed to have a dog-leg-like shape or a shape similar to the shape of the Japanese Hiragana character of "he", and the pressing spring portion 164 may press the conductor portion 52 against the contact portion 136 which functions as the corner portion.

Although the contact portion 136 is supported by the supporting spring portion 134 in the above-described embodiment, the present invention is not limited thereto. For example, a dowel may be used as the contact portion, wherein the dowel is formed as follows; a length of the first side portion 130 in the front-rear direction may be elongated, and the dowel is formed on the first side portion 130 so as to protrude in the receive portion 104. However, in terms of contact reliability between the conductor portion 52 and the contact portion 136, it is preferable for the supporting spring portion 134 to be formed to support the contact point 136 similar to the present embodiment because the contact point 136 can be positioned more inward in the receive portion 104.

In addition, although the connector 100 is provided with the positional regulating portions which consist of the first positional regulating portion 138 and the second positional regulating portion 168 in the above-described embodiment, the positional regulating portions can be omitted according to needs for the connector 100.

Moreover, although the connector 100 is used for the lighting device 10 in the above-described embodiment, the connector 100 may be used for another device. Even in this case, if the connector 100 according to the present embodiment is used therefor, the connector 100 and the conductor portion 52 can be electrically connected with each other only by inserting the conductor 52 of the cable 50 into the connector 100.

The present application is based on a Japanese patent application of JP2013-090147 filed before the Japan Patent Office on Apr. 23, 2013, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

10 lighting device
12 heat radiation member
14 heat transmission member
16 substrate
17F, 17R conductive pattern
18 screw
20 LED element
22 cover
24 component fixing member
26 base portion
50 cable
52 conductor portion
54 outer cover
100 connector
102 insertion opening
104 receive portion
110 bottom portion
112 lower guide portion
114 front connection portion
116 recess
118 rear connection portion
120 first section
130 first side portion
132 first guide portion
134 supporting spring portion
136 contact portion
138 first positional regulating portion (positional regulating portion)
140 first top portion
142 upper guide portion
144 first engagement portion
150 second section
160 second side portion
162 second guide portion
164 pressing spring portion
166 corner portion
168 second positional regulating portion (positional regulating portion)
170 second top portion (suction surface)
172 protrusion portion
174 second engagement portion

What is claimed is:

1. An electrical connector having, at a front end thereof, an insertion opening which enables a conductor portion of a cable to be inserted thereinto along a front-rear direction, wherein:

the electrical connector has a bottom portion, a first section and a second section;

the bottom portion has opposite ends in a lateral direction perpendicular to the front-rear direction;

the first section and the second section extend from the opposite ends, respectively, of the bottom portion;

the first section and the second section overlap with each other so that the first section, the second section and the bottom portion form the insertion opening;

the first section is formed with a first engagement portion;

the second section is formed with a second engagement portion;

the first engagement portion and the second engagement portion face each other in a perpendicular direction perpendicular to the front-rear direction;

even if at least one of the first section and the second section receives a force which forces the first section and the second section to be away from each other in the lateral direction, the first engagement portion and the second engagement portion are brought into abutment with each other in the perpendicular direction;

the bottom portion is formed with a lower guide portion;

the first section is formed with a first guide portion extending outward in the lateral direction and an upper guide portion extending upward;

the second section is formed with a second guide portion extending outward in the lateral direction;

the lower guide portion, the first guide portion, the upper guide portion and the second guide portion form the insertion opening;

the first engagement portion is formed of one of side edges of the upper guide portion, the one of side edges being near to the first guide portion;

the second section is positioned partially over the first section;

the second section has a protrusion portion which protrudes into one of side spaces of the upper guide portion, the one of side spaces being near to the first guide portion; and the second engagement portion is formed of one of side edges of the protrusion portion, the one of side edges being configured to abut the one of side edges of the upper guide portion and near to the second guide portion.

2. The electrical connector as recited in claim 1, wherein:

the first section and the second section overlap with each other at an upper portion of the electrical connector; and the perpendicular direction is the lateral direction.

3. The electrical connector as recited in claim 1, wherein:

the first section is formed with a contact portion which is brought into contact with the conductor portion of the cable; and the second portion is formed with a pressing spring portion which presses the conductor portion against the contact portion.

4. The electrical connector as recited in claim 3, wherein the contact portion or the pressing spring portion is provided with a corner portion which is brought into pressing contact with the conductor portion when the pressing spring portion presses the conductor portion against the contact portion.

5. The electrical connector as recited in claim 3, wherein:

the first section is formed with a supporting spring portion which is resiliently deformable; and the contact portion is supported by the supporting spring portion.

6. The electrical connector as recited in claim 3, wherein:

the electrical connector further has a positional regulating portion which regulates a position of the conductor portion of the inserted cable in the lateral direction; and the contact portion and the pressing spring portion are positioned between the positional regulating portion and the insertion opening in the front-rear direction.

7. The electrical connector as recited in claim 1, wherein the lower guide portion, the first guide portion, the upper guide portion and the second guide portion are positioned at positions same as each other in the front-rear direction.

8. The electrical connector as recited in claim 1, wherein:

the second section has a second top portion;

the second top portion has a plate-like shape which is mainly perpendicular to an up-down direction perpendicular to both the front-rear direction and the lateral direction; and the second top portion is used as a suction surface which is picked up by vacuum suction in an automated placement process.

9. A lighting device comprising: an LED (light-emitting diode) element; a substrate on which the LED element is mounted; the electrical connector as recited in claim 1 which is connected to and fixed on the substrate; and a cable which is inserted into the electrical connector while being connected to the LED element through the electrical connector and the substrate.

* * * * *